United States Patent [19]

Rowell

[11] Patent Number: 4,770,650

[45] Date of Patent: Sep. 13, 1988

[54] BRASSIERE WIRES AND METHOD OF FORMING SAME

[76] Inventor: Ross Rowell, 15 Lakeshore Road, Pointe Claire, Quebec, Canada, H9S 4G9

[21] Appl. No.: 887,903

[22] Filed: Jul. 18, 1986

Related U.S. Application Data

[63] Continuation-in-part of Ser. No. 794,453, Nov. 4, 1985, abandoned.

[30] Foreign Application Priority Data

Sep. 4, 1985 [CA] Canada ..... 489992

[51] Int. Cl.[4] ..... A41C 1/14

[52] U.S. Cl. ..... 450/52; 450/41

[58] Field of Search ..... 450/52, 32, 33, 41, 450/45; 148/39, 34

[56] References Cited

U.S. PATENT DOCUMENTS

| | | | |
|---|---|---|---|
| 1,934,741 | 11/1933 | Schulein | 148/39 |
| 2,746,052 | 5/1956 | Schwartz | 128/476 |
| 3,605,753 | 9/1971 | Schwartz | 450/52 |
| 4,133,316 | 1/1979 | Schwartz | 450/52 |
| 4,235,240 | 11/1980 | Cousin | 128/476 |
| 4,418,696 | 12/1983 | Delet | 450/52 |

OTHER PUBLICATIONS

Mark's Standard Handbook For Mechanical Engineers, 7th ed., 1958, Section 6-19, "Annealing".

*Primary Examiner*—Louis K. Rimrodt
*Assistant Examiner*—J. L. Olds
*Attorney, Agent, or Firm*—Robert J. Schaap

[57] ABSTRACT

The present invention provides an improved brassiere wire and a method for forming the same wherein the wire, which if formed of a spring steel, is subjected to an annealing treatment along the leg portions of the wire to thereby render the point or a section of the wire softer and more bendable.

6 Claims, 1 Drawing Sheet

BRASSIERE WIRES AND METHOD OF FORMING SAME

Figure 1:
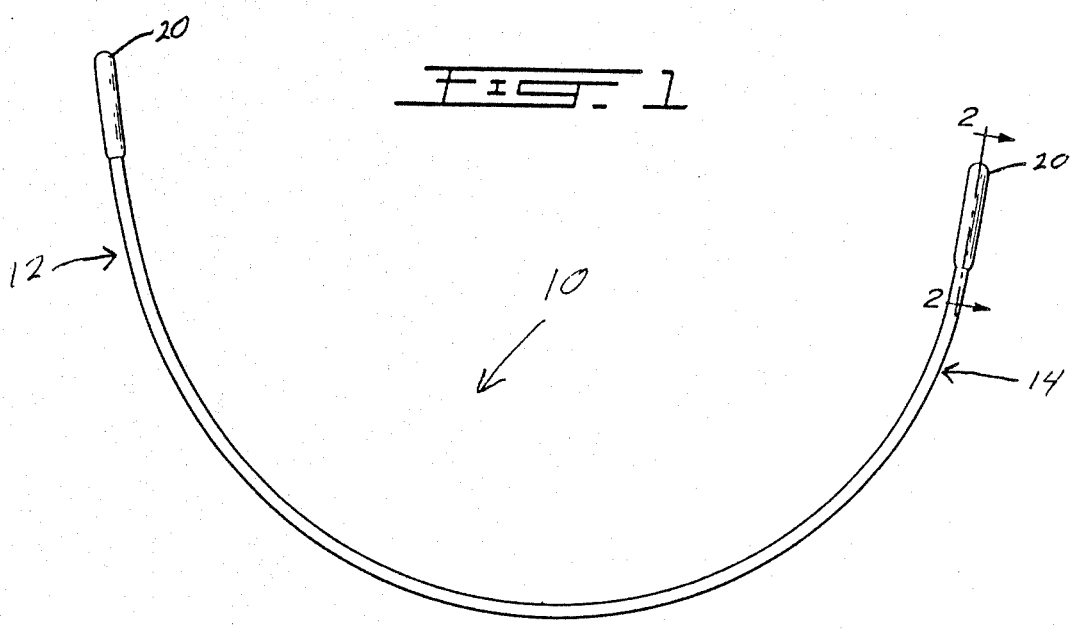

This application is a continuation-in-part of co-pending application Ser. No. 794,453 filed Nov. 4, 1985, abandoned.

The present invention relates generally to brassieres and more particularly, relates to improvements in wire members for use in brassieres.

The use of metallic wires or frames as stiffening members or frames in the manufacture of brassieres is well known in the art. The wires have a generally U-shaped configuration extending along the side peripheral portions of the brassiere cups and are generally of a rectangular cross sectional configuration with the longer dimension extending radially with respect to the curvature of the wire. The wires are secured to the brassiere by enclosing the wires within the fabric along the perimeter of the brassiere cups. The wires may be retained by means of stitching about the ends of the wires. Reference may be had to U.S. Pat. No. 3,799,175 to Rowell which illustrates a typical wire.

Typically, as is known in the art, the brassiere wires or frames may be formed of a spring steel and in particular, a high carbon spring steel which is well known for its suitability.

As aforementioned, the use of metallic wires as stiffening members for frames has been found to be suitable insofar as they provide suitable support and definition for the garment. However, since the wire used is by its very nature a stiff wire, it can cause problems insofar as comfort is concerned and in addition, when the brassiere is repeatedly washed, shrinkage of the fabric can cause the wires to tear through the stitching or fabric of the brassiere (poke-through) and become a source of discomfort. It has been proposed in the art to provide plastic end caps or tips on the ends of the wires; although such plastic wires have a lesser tendency to tear through the fabric, the ends of the wires remain relatively stiff and can be a source of discomfort to the wearer.

It has also been proposed in the art to provide end caps or tips wherein the plastic material forming the cap extends beyond the end of the wire for a substantial distance. The end cap is of a flexible material and thus renders the end of the wire more resilient than would otherwise be the case. While such a construction provides substantial advantages over the bare metallic stiffening member, it has been found that these members which are slipped on the wire may become disengaged therefrom after repeated washing of the garment. Furthermore, these end caps are frequently secured to the wire after the same has been inserted in the garment and the manual operation of so doing is an expensive one.

It is the object of the present invention to provide an improved stiffening member suitable for use in a brassiere wherein the stiffening member has one or more portions which are softer and more flexible than the remaining portions.

It is the further object of the present invention to provide a method for rendering a stiffening member in a brassiere softer and more flexible.

It is a still further object of the present invention to provide a brassiere having a greater comfort for the wearer and having less of a "poke-through" problem.

In one aspect of the invention, in a stiffening member for a brassiere wherein the member is formed of a metallic spring wire material having a generally U-shaped configuration, there is provided the improvement wherein a portion of the stiffening member is subjected to an annealing operation to thereby soften said portion.

In a further aspect of the invention, there is provided a method for treating a stiffening member suitable for use in a brassiere, the method comprising the step of annealing a portion of the member which is formed of a metallic spring wire material.

In greater detail, the preferred improved stiffening member of the present invention comprises a conventional U-shaped wire having a generally rectangular cross-sectional configuration with the longer dimension extending radially with respect to the curvature of the wire. The wire is formed of a spring wire material. At least a portion of the spring wire is subjected to an annealing step to soften the portion treated and thereby render the same more flexible or bendable and to provide greater comfort to the wearer.

The stiffening member may be subjected to the aforesaid annealing operation at one or more places. Thus, it is within the scope of the present invention to only anneal the wire at a single location where the desired material softness is required. Preferably, however, the stiffening member is annealed at two different places, each place being adjacent the end of one of the legs of the member. The location of the annealed portion of the wire may vary depending upon the size of the wire and the particular garment in which it is to be utilized. In general terms, the wire would be annealed at a position ranging from the end of each leg to a distance of 4 inches from the end of the leg. In the most preferred embodiment, the stiffening member or frame would be annealed at a position ranging between $\frac{1}{4}'$ to 1 inch from the end of the leg and a distance of $\frac{1}{2}''$ has been found to be very suitable.

The length of the annealed portion can also vary according to the requirements of the designer. Thus, a very small portion, typically $\frac{1}{8}''$ to $\frac{3}{4}''$ in length, may be subjected to the annealing or alternatively, again depending on the ultimate end use of the member, a larger length may be annealed.

Following the annealing, the annealed portion is desirably provided with a protective coating or subjected to a further treatment to prevent oxidation of the metallic member.

The means of annealing the member may be chosen from among many well known to those knowledgeable in the art. Thus, one may use various types of flames to anneal or alternatively, an induction type of annealing could be utilized. One attractive alternative is to utilize high intensity infrared line heaters. These heaters generate highly concentrated radiant heat flux density along a thin line at the external focal axis of an elliptical reflector. Such heaters produce rapid heating rates and high temperatures which can be focused very precisely at the desired location. The specific time and temperature will again be a choice which can be made by those knowledgeable in the art; typically, the spring wire to be used in a brassiere wire would be heated to a temperature of above 1600° F. and air cooled. The specific temperature and time of treatment can be varied as is well known by those skilled in the art in order to achieve the desired result. This annealing treatment will substantially reduce the hardness of the material; again, it is well within the knowledge of those skilled in the art to vary the hardness to achieve the results desired for a particular required design of brassiere wire.

Figure 2:
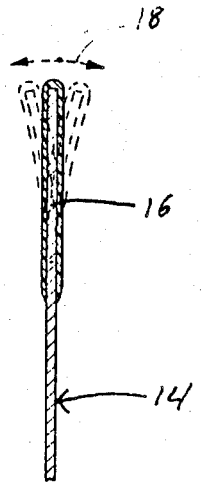

Having thus generally described the invention, reference will be made to the accompanying drawings illustrating an embodiment thereof, in which:

FIG. 1 is a plan view of a typical brassiere wire according to the present invention; and FIG. 2 is a sectional view taken along the lines 2—2 of FIG. 1.

Referring to the drawings in greater detail, there is illustrated in FIG. 1 a typical stiffening member 10 which is suitable for use in a brassiere. Member 10 has a generally U-shaped configuration with two leg portions which are designated by reference numerals 12 and 14. Adjacent the free end of legs 12 and 14, the material is subjected to an annealing operation as designated by reference numeral 16. This annealing operation at the point 16 renders this point "softer" and permits movement of the free ends as shown by arrow 18. Subsequent to the annealing operation, a protective coating 20 is provided; protective coating 20 may be of a suitable material, typically a latex material.

The method for forming the stiffening member is well understood by those knowledgeable in the art. Thus, a roll of a suitable continuous spring wire material is supplied. This material has normally been subjected to annealing and tempering treatments as is conventional in the art. The wire material is cut to a suitable length and formed into the U-shaped members such as shown in FIG. 1. Subsequent to the forming of the material into the individual U-shaped stiffening members, the legs are subjected to the annealing treatment to soften the desired portion. Subsequently, the protective coating is applied to the ends of the stiffening members or wires.

It will be understood that the above described embodiment is for purposes of illustration only and that changes and modifications may be made thereto without departing from the spirit and scope of the invention.

I claim:

1. In a stiffening member for a brassiere wherein the member is formed of a metallic spring wire material and has a generally U-shaped configuration, the improvement wherein a portion of said member has been annealed to thereby soften said portion.

2. The improvement of claim 1 wherein said U-shaped member has a pair of legs, each of said legs having a portion thereof which has been annealed.

3. The improvement of claim 1 or 2 wherein said annealed portion is provided with a protective coating.

4. The improvement of claim 2 wherein said annealed portion is spaced a distance of between ¼" to about 1" from the end of said legs.

5. A method of treating a stiffening member used in a brassiere wherein said stiffening member has a generally U-shaped configuration, the method comprising the steps of supplying a continuous length of wire which has been annealed and tempered, cutting and forming said continuous length of wire into U-shaped members having a pair of legs, subjecting at least a portion of each said pair of legs to an annealing treatment to soften said portion, and subsequently applying a protective coating to said annealed sections.

6. The method of claim 5 when the step of subjecting said legs to an annealing treatment comprises the step of subjecting a length of between ⅛" to ¾" to said annealing treatment, said portion being spaced a distance of between ¼" and 1" from the end of the legs.

* * * * *